US006078235A

United States Patent [19]

Schebitz et al.

[11] Patent Number: 6,078,235

[45] Date of Patent: Jun. 20, 2000

[54] ELECTROMAGNETIC ACTUATOR AND HOUSING THEREFOR

[75] Inventors: Michael Schebitz, Eschweiler-Fronhoven; Ulrich Müller, Alsdorf; Enno Lohse, Stolberg-Büsbach; Martin Scheidt, Adelsdorf, all of Germany

[73] Assignee: FEV Motorentechnik GmbH & Co. KG, Aachen, Germany

[21] Appl. No.: 09/115,605

[22] Filed: Jul. 15, 1998

[30] Foreign Application Priority Data

Jul. 15, 1997 [DE] Germany ..... 297 12 502 U

[51] Int. Cl.[7] ..... H01F 7/08

[52] U.S. Cl. ..... 335/220; 335/251; 335/255; 123/90.11; 239/585.1; 251/129.01

[58] Field of Search ..... 251/129.15–129.22, 251/129.01; 335/220, 229, 251, 285; 239/585.1, 585.2, 585.3, 585.4, 585.5; 123/90.11

[56] References Cited

U.S. PATENT DOCUMENTS

| | | | |
|---|---|---|---|
| 4,582,088 | 4/1986 | Cook et al. | 137/625.65 |
| 5,131,624 | 7/1992 | Kreuter et al. | 251/129.18 |
| 5,350,153 | 9/1994 | Morinigo | 251/129.16 |
| 5,548,263 | 8/1996 | Bulgatz et al. | 335/274 |
| 5,690,064 | 11/1997 | Izuo | 123/90.11 |
| 5,704,314 | 1/1998 | Allmendinger et al. | 123/90.11 |
| 5,720,468 | 2/1998 | Morinigo | 251/129.1 |
| 5,730,091 | 3/1998 | Diehl et al. | 123/90.11 |
| 5,782,454 | 7/1998 | Bulgatz et al. | 251/129.1 |
| 5,785,016 | 7/1998 | Enderle et al. | 123/90.11 |
| 5,804,962 | 9/1998 | Kather et al. | 325/207.16 |
| 5,868,108 | 2/1999 | Schmitz et al. | 123/90.11 |

*Primary Examiner*—Michael L. Gellner
*Assistant Examiner*—Tuyen T. Nguyen
*Attorney, Agent, or Firm*—Venable; Gabor J. Kelemen

[57] ABSTRACT

An electromagnetic actuator for operating a setting member includes an electromagnet which has a housing provided with a recess having an opening; a yoke body having a surface constituting a pole face of the electromagnet; and a solenoid surrounding the yoke body. The yoke body and the solenoid are accommodated in the housing recess. An armature, to which the setting member is coupled, is guided for motions towards and away from the pole face in a space adjoining the electromagnet. The opening of the housing recess faces the space. A resetting spring exerts a force opposing a motion of the armature towards the pole face.

9 Claims, 2 Drawing Sheets

ELECTROMAGNETIC ACTUATOR AND HOUSING THEREFOR

CROSS REFERENCE TO RELATED APPLICATION

This application claims the priority of German Application No. 297 12 502.8 filed Jul. 15, 1997, which is incorporated herein by reference.

BACKGROUND OF THE INVENTION

This invention relates to an electromagnetic actuator for operating a setting member and particularly concerns electromagnetic actuators for use in automotive vehicles.

SUMMARY OF THE INVENTION

It is an object of the invention to provide an improved electromagnetic actuator which is particularly adapted for mass production in large quantities in an economical manner.

This object and others to become apparent as the specification progresses, are accomplished by the invention, according to which, briefly stated, the electromagnetic actuator for operating a setting member includes an electromagnet which has a housing provided with a recess having an opening; a yoke body having a surface constituting a pole face of the electromagnet; and a solenoid surrounding the yoke body. The yoke body and the solenoid are accommodated in the housing recess. An armature, to which the setting member is coupled, is guided for motions towards and away from the pole face in a space adjoining the electromagnet. The opening of the housing recess faces the space. A resetting spring exerts a force opposing a motion of the armature towards the pole face.

In a construction according to the invention as outlined above, the electromagnet is of compact configuration which—by virtue of a housing for receiving the yoke body provided with a solenoid—at the same time also has the elements required for an assembly into a complete electromagnetic actuator as well as for its installation in its operating environment.

The electromagnet according to the invention lends itself advantageously for mass production because the assembling work may be carried out by means of but a few joining operations for which automated processes may be utilized. In such an operation, first the solenoid is inserted into the yoke body and thereafter the yoke body is inserted into the housing together with the solenoid. The securement of the solenoid to the yoke body may be effected by casting into the remaining intermediate spaces a hardening synthetic mass which serves both for fixing the yoke body in the housing and fixing the solenoid on the yoke body. As a result, wider tolerances may be used. At the same time, the synthetic mass electrically insulates the solenoid from the housing and the yoke body and also, a heat transfer is made possible. The housing is expediently of a non-magnetic metal such as aluminum or an aluminum alloy, whereby the additional advantage is provided to economically make the housing in large quantities and shapes that correspond to the individual requirements.

According to an advantageous feature of the invention, the yoke body is of parallelepiped shape, and the pole faces are provided with at least two parallel grooves which extend transversely to the plane of the individual laminae of the yoke body. The solenoid is received at least partially in the grooves. Making the yoke body of individual laminae which are oriented perpendicularly to the pole faces has the advantage that the basic elements for the yoke body may be made by a stamping process from sheet metal and the individual sheet metal pieces (laminae) may be thereafter firmly connected to one another, for example, by laser welding to form a compact body. A construction of the yoke body from individual metal laminae has the further advantage that the generation of eddy currents is substantially suppressed, and thus the required rapid build-up and decay of the magnetic field are ensured. Instead of laminae, however, the yoke body may be made by other shaping processes from materials which have the required magnetic properties and which, based on their construction, permit only to a slight extent the eddy currents inherently generated by the alternating magnetic field. Thus, for example, it is feasible to make the yoke body as a sintered member by a powder-metallurgical process. By the provision of two parallel grooves, the insertion of a solenoid made as a "rectangular annulus" is facilitated.

According to another feature of the invention, the recess in the housing is open towards two opposite sides and the inserted yoke body forms one part of the lateral faces of the electromagnet in that region. In this manner, very narrow electromagnetic actuators may be built which may be installed closely side-by-side which is desirable when only tight space is available, for example, for electromagnetic actuators operating cylinder valves in internal-combustion engines.

According to a further feature of the invention, the recess in the housing is associated with an additional opening for receiving terminal contacts of the inserted solenoid. Such an arrangement is advantageous in that the completely assembled electromagnetic actuator, particularly a two-magnet electromagnetic actuator to be detailed later, may be connected to the electric control apparatus by a plug connection which may be of the blade/clip type. This construction further has the advantage that in that region further terminal contacts for sensors or the like may be provided, and the connection of the actuators to an electric control apparatus may be effected by a coded plug which ensures the correct polarity.

According to still another advantageous feature of the invention, on its side oriented away from the pole faces of the inserted yoke body, the housing is provided with a tubular cavity for receiving one end of a resetting spring. Expediently, the tubular cavity extends up to the recess in the housing. Apart from a simple manufacture, it is feasible to advantageously use the tubular cavity as a holding and guiding means during the joining operation for assembling the actuator. Thus, for example, after inserting the yoke body carrying the solenoid, the tubular cavity may serve as a holding and guiding means for the inserted resetting spring in case the latter subsequently has to be installed together with the armature.

In accordance with a particularly advantageous feature of the invention, two electromagnets are interconnected and separated by spacers such that the pole faces are oriented towards one another. In the space between the pole faces an armature is guided for a back-and-forth movement against forces of return springs and the housings of the two electromagnets are arranged in a mirror image to one another. It is an advantage of such an electromagnetic actuator, used in particular for operating a cylinder valve in an internal-combustion engine, that the actuator may be composed of electromagnets having identical shapes. The stroke of the armature between the two pole faces may be preset by means of the spacers between the two electromagnets. Further, the location of the spring seat for one of the resetting springs may be varied by means of spacer washers to thus vary the position of rest of the armature between the two pole faces when the electromagnets are in a de-energized state. According to yet another advantageous feature of the invention, the housings of the electromagnets and the spacers are each provided with centering elements so that in case the joining of the individual components is effected by plug-in steps, already at that stage the required precise positioning of the individual elements relative to one another is obtained. Accordingly, a later securement of the actuator to a carrier, for example, by means of tightening screws, has no effect on the centering. The centering elements may also serve as connecting elements for the actuator components. For example, connecting pins may be riveted at their end. Advantageously, each centering element is a tube which passes through aligned holes provided in the housing of the electromagnets and in the spacers and which also serves for firmly connecting the components with one another. Such a connection may be effected, for example, by crimping the spacer tube ends.

DESCRIPTION OF THE PREFERRED EMBODIMENT

Figure 1:
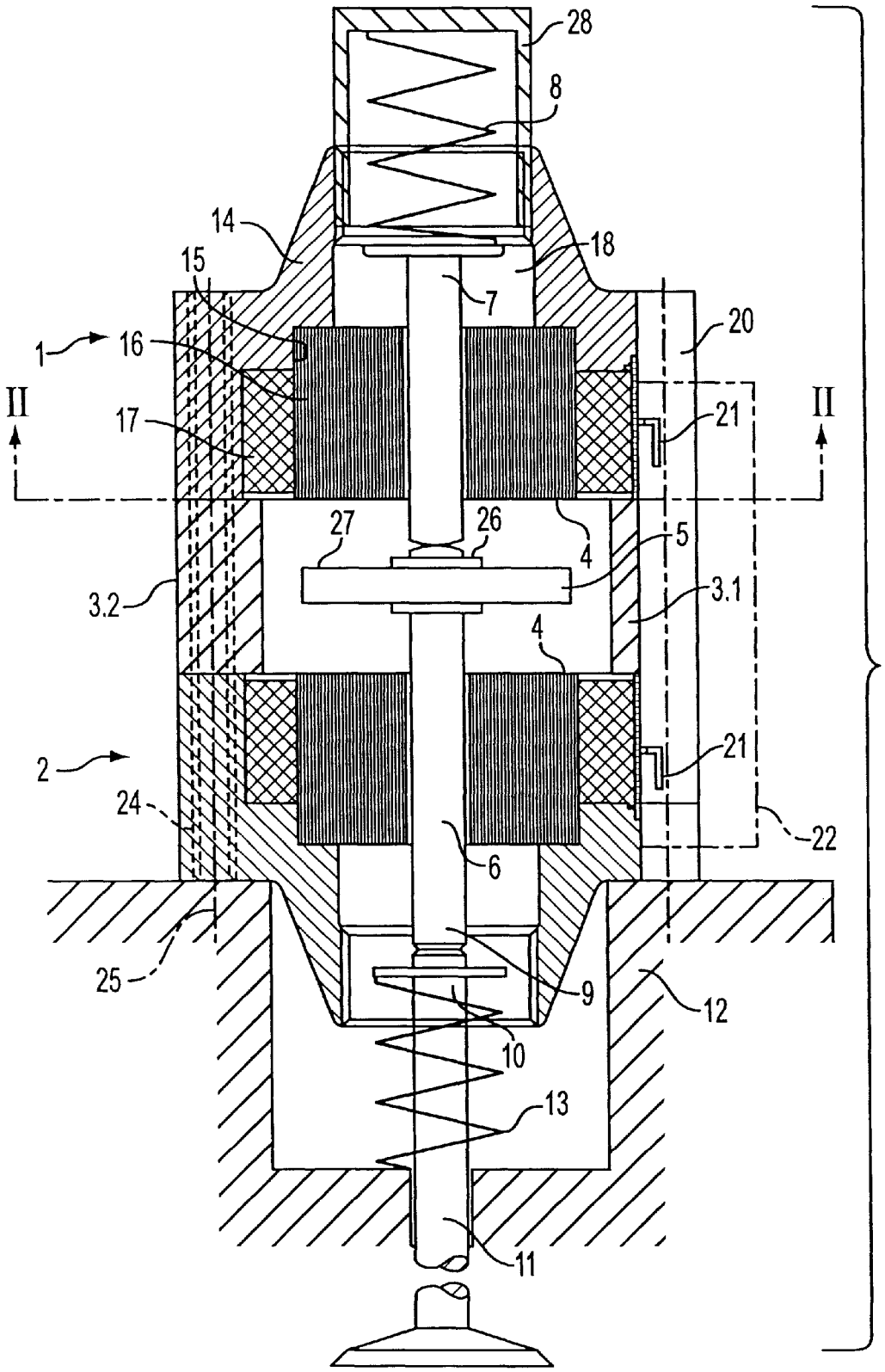
FIG. 1 is an axial sectional view of an electromagnetic actuator taken along line I—I of FIG. 2.

The electromagnetic actuator illustrated in FIG. 1 is formed essentially of two electromagnets 1 and 2 which are arranged at a distance from one another by means of spacers 3.1 and 3.2 and whose pole faces 4 are oriented towards one another. In the free space between the two pole faces 4 an armature 5 is arranged which is guided, for example, by means of a guide rod 6, to execute back-and-forth motions. In the illustrated embodiment the armature 5 has a rectangular outline.

The guide rod 6 which is divided into consecutive length portions, is, at its upper end 7, operatively connected with a resetting spring 8. The other, lower free end 9 of the guide rod 6 engages the free end 10 of a stem 11 of a valve which is guided in an only symbolically shown cylinder head 12 of an internal-combustion engine. A resetting spring 13 urges the valve into its closed position. The forces exerted by the two resetting springs 8 and 13 oppose one another so that in a de-energized state of the electromagnets 1 and 2 the armature 5 is held in a position of rest between the two pole faces 4 of the electromagnets 1 and 2, as depicted in FIG. 1. If, during operation, the two electromagnets 1 and 2 are alternately energized, the armature 5 accordingly shuttles between the pole faces 4 of the two electromagnets 1 and 2, and the cylinder valve is, for the duration of the energization, alternatingly held in the open position (engagement with the pole face of the electromagnet 2) against the force of the resetting spring 13 and in the closed position (engagement with the pole face of the electromagnet 1) against the force of the resetting spring 8.

The electromagnetic actuator illustrated in FIG. 1 constitutes a structural unit which is composed of identical elements in a module-like manner. The two electromagnets 1 and 2 are preferably of identical structure and are each formed essentially of a housing 14 which has a recess 15 open in the direction of the armature 5 for accommodating a yoke body 16, together with a solenoid 17 carried by the yoke body 16. The housing 14 further has a tubular cavity 18 which receives the respective resetting spring 8 or 13.

Figure 2:
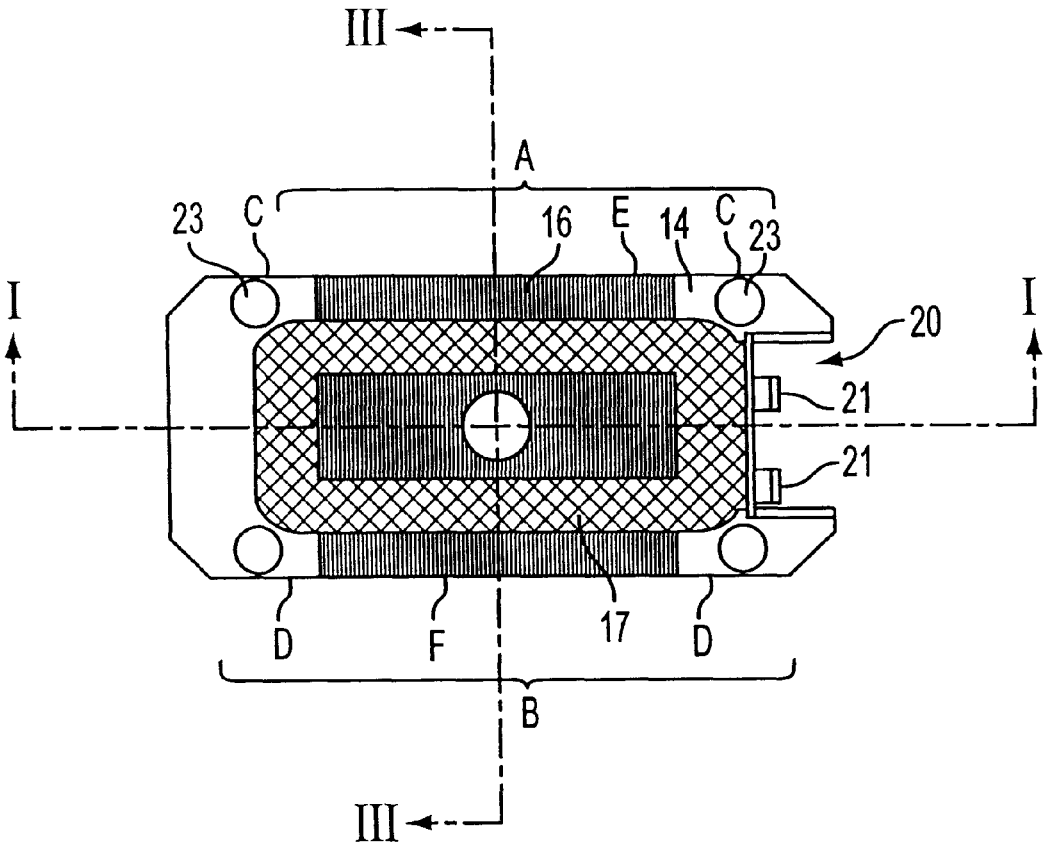
FIG. 2 is a sectional view taken along lire II—II of FIG. 1.
Figure 3:
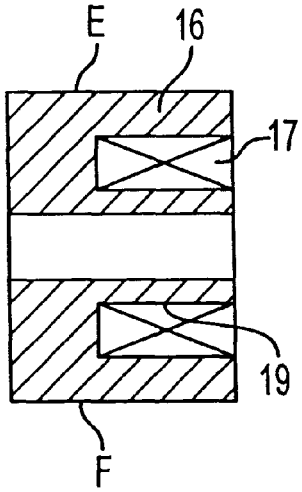
FIG. 3 is a sectional view of one part of the structure shown in FIG. 2, taken along line III—III of FIG. 2.

As seen in FIGS. 2 and 3, the yoke body 16 is formed of a parallelepiped-shaped element which is composed of a plurality of sheet metal laminae which are firmly bonded to one another, for example, by means of laser welding. The yoke body 16 is provided with two parallel grooves 19 receiving two parallel sides (legs) of the solenoid 17, shaped as a rectangular annulus. Those legs of the solenoid 17 which flank the yoke body 16 at the outside are laterally covered by the housing 14 as shown in FIGS. 1 and 2.

The housing 14 is structured in such a manner that the recess 15 is open towards opposite sides so that the inserted yoke body 16 forms in that zone one part of the lateral surface of the electromagnet. Stated differently, the electromagnet 1 has two opposite outer lateral surfaces A and B. Further, the housing 14 has two opposite outer lateral surfaces C and D and the yoke body 16 has two opposite outer lateral surfaces E and F. The outer lateral surface A of the electromagnet is composed of the outer lateral surface C of the housing 14 and the outer lateral surface E of the yoke body 16, whereas the outer lateral surface B of the electromagnet 1 is composed of the outer lateral surface D of the housing 14 and the outer lateral surface F of the yoke body 16. The outer lateral surface E of the yoke body 16 is flush with the outer lateral surface C of the housing 14 and the outer lateral surface F of the yoke body 16 is flush with the outer lateral surface D of the housing 14, since the yoke body 16 is fitted in the recess 15 provided in the housing 14. As a result, as it may be observed in FIG. 2, very narrow electromagnetic actuators are obtained which may be arranged closely side-by-side. The yoke body 16, together with the solenoid 17, is inserted into the recess 15 of the housing 14 and is positioned and immobilized therein by means of a cast mass.

The housing 14 further has an additional lateral opening 20 which provides for an access to the terminal contacts 21 of the solenoid 17. By virtue of this arrangement the two electromagnets may be connected with the associated control device by means of a one-piece plug 22—shown in dash-dot lines in FIG. 1—which is expediently coded to prevent accidental reversal of polarities upon making the connections. The plug 22 is guided and protected by the side faces of the opening 20.

As further seen in FIG. 2, the housing 14 made, for example, of a die-cast aluminum alloy, has four passages (bores) 23 which extend parallel to the axis of the guide rod 6 and which are aligned with corresponding passages in the spacers 3.1 and 3.2. This arrangement makes possible to firmly tighten to one another all components by means of suitable tightening screws 24 as shown in dash-dot lines in FIG. 1.

Expediently, centering elements are provided to obtain a mutual accurate geometrical alignment of the two electromagnets 1 and 2 and the spacers 3.1 and 3.2. As a simple solution, such centering elements may be formed by tubular elements 25 which pass through the aligned bores 23 substantially along their entire length so that the components of the electromagnetic actuator are axially aligned with one another in a relatively non-rotatable manner. The ends of the tubular elements 25 are crimped or riveted so that the actuator components are connected firmly with one another as unit. It is also feasible to introduce tension screws through two diagonally opposite bores 23 (or through all passages) for bracing the actuator as a structural unit and, at the same time, for tightening the unit to an engine block as shown in FIG. 1.

In the illustrated embodiment the armature 5 has a rectangular outline and corresponds in its size to that of the yoke body 16 as shown in FIG. 2. As it may be seen from FIG. 1, the armature 5 has, in the region where it is fixedly coupled with the guide rod 6, a central collar 26 situated on opposite flat sides of the armature 5 and projecting axially beyond the armature surface 27 by a predetermined extent. By means of this arrangement a defined air gap between the armature face 27 and the pole face 4 of the respective electromagnets 1 and 2 may be predetermined, and it is also feasible to obtain different widths for the air gap when the armature 5 engages the electromagnet 1, on the one hand, and the electromagnet 2, on the other hand. The radial dimension of the collar 26 may further determine and adapt the radial face of the air gap to requirements. The upper resetting spring 8 is countersupported by the bottom of a sleeve-like setting element 28 which is threadedly received in the tubular cavity 18 of the housing 14. Thus, by turning the setting element 28 in the housing 14, the axial location of the setting element 28 may be changed, thus varying the spring force exerted on the armature 5, as a result of which the position of rest of the armature 5 between the two pole faces 4 of the opposite electromagnets 1 and 2 may be set.

According to a variant the spacers 3.1 and 3.2 are formed as one-piece components with one of the housings 14 or to arrange one of the spacers at one housing 14 and the spacer at the other housing 14 as a one-piece component thereof.

It will be understood that the above description of the present invention is susceptible to various modifications, changes and adaptations, and the same are intended to be comprehended within the meaning and range of equivalents of the appended claims.

What is claimed is:

1. An electromagnetic actuator for operating a setting member, comprising (a) two electromagnets each having a first outer lateral surface and a second outer lateral surface opposite said first outer lateral surface; each said electromagnet including (1) a respective housing made of a non-magnetic material and defined by a housing wall having a first outer lateral surface constituting one part of said first outer lateral surface of said electromagnet and a second outer lateral surface constituting one part of said second outer lateral surface of said electromagnet;

(2) a recess provided in said housing wall;

(3) a yoke body fixedly held in said housing and occupying said recess; said yoke body having (i) a first outer lateral surface constituting one part of said first outer lateral surface of said electromagnet;

(ii) a second outer lateral surface constituting one part of said second outer lateral surface of said electromagnet; and (iii) an end surface constituting a pole face of the electromagnet; said yoke body forming a lateral face of said electromagnet in a region of said first and second openings; and (4) a solenoid supported by said yoke body and being fixedly held in said housing;

(b) spacers interconnecting said electromagnets in a mirror image to one another and maintaining the housings of the two electromagnets separated from one another;

(c) an armature movable towards and away from the pole faces of said electromagnets in said space;

(d) two oppositely acting resetting springs opposing motions of said armature towards respective said pole faces;

(e) means for guiding said armature in displacements thereof; and (f) means for coupling said armature to the setting member.

2. The electromagnetic actuator as defined in claim 1, wherein said yoke body is a parallelepiped-shaped component made of a magnetic material and permitting only insubstantial eddy current generation therein by an alternating electromagnetic field; further wherein said pole face is provided with at least two parallel grooves oriented parallel to said lateral face; said grooves at least partially receiving said solenoid.

3. The electromagnetic actuator as defined in claim 2, wherein said yoke body is composed of a plurality of superposed laminae oriented perpendicularly to said pole face.

4. The electromagnetic actuator as defined in claim 1, wherein said solenoid includes terminal contacts; further wherein said housing has a lateral opening receiving said terminal contacts.

5. The electromagnetic actuator as defined in claim 1, wherein said housing has an opening facing away from said space; further comprising a tubular cavity situated adjacent said opening; said tubular cavity receiving at least one part of said resetting spring.

6. The electromagnetic actuator as defined in claim 5, wherein said tubular cavity extends to said opening and is in communication therewith.

7. The electromagnetic actuator as defined in claim 1, further comprising centering elements cooperating with said housing of said electromagnets and with said spacers for centering said electromagnets relative to one another.

8. The electromagnetic actuator as defined in claim 7, wherein said centering elements include means for tightening the housings and the spacers to one another.

9. The electromagnetic actuator as defined in claim 8, wherein said housings and said spacers are provided with aligned bore holes; further wherein each said centering element comprises a tube passing through said aligned bore holes; said means for tightening including a tightening bolt received in each said tube along at least a length portion thereof.

* * * * *